US006914991B1

(12) United States Patent
Pompei

(10) Patent No.: US 6,914,991 B1
(45) Date of Patent: Jul. 5, 2005

(54) PARAMETRIC AUDIO AMPLIFIER SYSTEM

(76) Inventor: Frank Joseph Pompei, 16 Peck Ave., Wayland, MA (US) 01778

( * ) Notice: Subject to any disclaimer, the term of this patent is extended or adjusted under 35 U.S.C. 154(b) by 629 days.

(21) Appl. No.: 09/836,778

(22) Filed: Apr. 17, 2001

Related U.S. Application Data

(60) Provisional application No. 60/197,933, filed on Apr. 17, 2000.

(51) Int. Cl.[7] ..... H04R 3/00

(52) U.S. Cl. ..... 381/111; 381/120; 381/116

(58) Field of Search ..... 381/111, 120, 381/116, 112–115, 117, 160, 77, 91, 337, 340, 174; 367/157

(56) References Cited

U.S. PATENT DOCUMENTS

| | | | | |
|---|---|---|---|---|
| 5,471,540 A | * | 11/1995 | Maeda | 381/191 |
| 6,556,687 B1 | * | 4/2003 | Manabe | 381/387 |
| 6,628,791 B1 | * | 9/2003 | Bank et al. | 381/113 |
| 2001/0007591 A1 | * | 7/2001 | Pompei | 381/111 |

* cited by examiner

*Primary Examiner*—Xu Mei
*Assistant Examiner*—Justin Michalski
(74) *Attorney, Agent, or Firm*—Weingarten, Schurgin, Gagnebin & Lebovici LLP

(57) ABSTRACT

A smaller, less expensive, parametric audio amplifier system configured to be conformable to cable routing requirements that are no more stringent than that of conventional loudspeaker systems. The parametric audio amplifier system includes an amplifier assembly for amplifying an ultrasonic carrier signal modulated with a processed audio signal, an acoustic transducer assembly for projecting a sonic beam corresponding to the amplified ultrasonic signal through the air to regenerate the audio signal, and a low voltage connection for carrying the amplified ultrasonic signal from the amplifier assembly to the acoustic transducer assembly. The amplifier assembly includes an amplifier for receiving the modulated ultrasonic signal and generating an amplified ultrasonic signal having a low voltage level, and a voltage source for generating a voltage level. The acoustic transducer assembly includes interface circuitry for receiving the amplified ultrasonic signal, and providing a drive signal to an acoustic transducer. The acoustic transducer assembly further includes a bias generator for receiving the voltage level, and providing a bias level to the acoustic transducer.

21 Claims, 4 Drawing Sheets

*Fig. 1 - Prior Art*

PARAMETRIC AUDIO AMPLIFIER SYSTEM

CROSS REFERENCE TO RELATED APPLICATIONS

This application claims priority of U.S. Provisional Patent Application No. 60/197,933 filed Apr. 17, 2000 entitled PARAMETRIC AUDIO AMPLIFIER SYSTEM.

STATEMENT REGARDING FEDERALLY SPONSORED RESEARCH OR DEVELOPMENT

N/A

BACKGROUND OF THE INVENTION

The present invention relates generally to parametric audio amplifier systems for generating airborne audio signals, and more specifically to a parametric audio amplifier system that employs a low voltage connection between an amplifier assembly and an acoustic transducer assembly.

Parametric audio amplifier systems are known that employ an acoustic transducer for projecting an ultrasonic carrier signal modulated with a processed audio signal through the air for subsequent regeneration of the audio signal along a selected path of projection. A conventional parametric audio amplifier system includes a modulator configured to modulate an ultrasonic carrier signal with a processed audio signal, a driver amplifier configured to amplify the modulated carrier signal, and at least one acoustic transducer configured to project a sonic beam corresponding to the modulated ultrasonic carrier signal through the air along a selected projection path. Because of the nonlinear propagation characteristics of the air, the projected sonic beam is demodulated as it passes through the air to regenerate the audio signal along the selected projection path.

One drawback of the conventional parametric audio amplifier system is that the acoustic transducer included therein is typically driven by the driver amplifier with a high voltage signal, which may be on the order of hundreds of volts. In contrast, a conventional loudspeaker is typically driven with a relatively low voltage signal of about 50 volts. For this reason, a high voltage connection configured to carry such high voltage signals is typically employed in the conventional parametric audio amplifier system to interconnect the driver amplifier and the acoustic transducer.

However, the use of high voltage connections in parametric audio amplifier systems can be problematic because such connections typically comprise specialized high voltage cables and/or connectors, which can significantly increase the size and cost of the system. Further, such high voltage cabling must typically conform to cable routing requirements that are more stringent than that of low voltage cabling used in conventional loudspeaker systems. As a result, special considerations must often be made when installing high voltage cabling for parametric audio amplifier systems, which can significantly increase the cost and complexity of the installation.

It would therefore be desirable to have a parametric audio amplifier system that has both reduced size and cost. Such a parametric audio amplifier system would be configured to be conformable to cable routing requirements that are no more stringent than that of conventional loudspeaker systems.

BRIEF SUMMARY OF THE INVENTION

A smaller, less expensive, parametric audio amplifier system is provided that is configured to be conformable to cable routing requirements that are no more stringent than that of conventional loudspeaker systems. The benefits of the presently disclosed amplifier system are achieved by configuring the system so that connections to an acoustic transducer assembly included therein carry only low voltage signals, and by disposing in the acoustic transducer assembly components required for generating high voltage signals to bias and/or drive an acoustic transducer.

In one embodiment, the parametric audio amplifier system includes an amplifier assembly configured to amplify an ultrasonic carrier signal modulated with a processed audio signal, at least one acoustic transducer assembly configured to project a sonic beam corresponding to the amplified ultrasonic signal through the air to regenerate the audio signal along a selected projection path, and a low voltage connection configured to carry the amplified ultrasonic signal from the amplifier assembly to the acoustic transducer assembly. The low voltage connection comprises at least one cable and a plurality of connectors adapted to connect the cable between the amplifier assembly and the acoustic transducer assembly, in which the cable and connectors are configured to carry low voltage signals. In a preferred embodiment, the connection cable comprises standard wire rated at about 300 volts. The amplifier assembly includes a power amplifier configured to receive the modulated ultrasonic signal and generate an amplified ultrasonic signal, and a DC voltage source configured to generate a DC voltage level. The low voltage connection is configured to provide the amplified ultrasonic signal and the DC voltage level to the acoustic transducer assembly. The acoustic transducer assembly includes a step-up transformer having a primary winding configured to receive the amplified ultrasonic signal, and a secondary winding configured to provide a stepped-up voltage signal corresponding to the amplified ultrasonic signal having a level ranging from about 200–300 volts peak-to-peak to an acoustic transducer by way of a DC blocking capacitor. In an alternative embodiment, the acoustic transducer assembly includes a resonant inductor connected in series with the DC blocking capacitor in place of the step-up transformer. The acoustic transducer assembly further includes a DC bias voltage generator configured to receive the DC voltage level, and provide a DC bias voltage level that ranges from about 100–400 volts DC to the acoustic transducer. The acoustic transducer is configured to receive the amplified ultrasonic signal and the DC bias voltage, generate a sonic beam corresponding to the ultrasonic signal and the DC bias voltage, and project the sonic beam through the air to regenerate the audio signal.

Other features, functions, and aspects of the invention will be evident from the Detailed Description of the Invention that follows.

BRIEF DESCRIPTION OF THE SEVERAL VIEWS OF THE DRAWING

The invention will be more fully understood with reference to the following Detailed Description of the Invention in conjunction with the drawings of which.

DETAILED DESCRIPTION OF THE INVENTION

U.S. Provisional Patent Application No. 60/197,933 filed Apr. 17, 2000 is incorporated herein by reference.

A parametric audio amplifier system is disclosed that is reduced in size, less expensive, and conformable to cable routing requirements that are no more stringent than that of conventional loudspeaker systems. The presently disclosed amplifier system achieves such benefits by providing a low voltage connection to an acoustic transducer assembly, and by disposing in the acoustic transducer assembly those components required to generate high voltage signals for biasing and/or driving an acoustic transducer.

Figure 1:
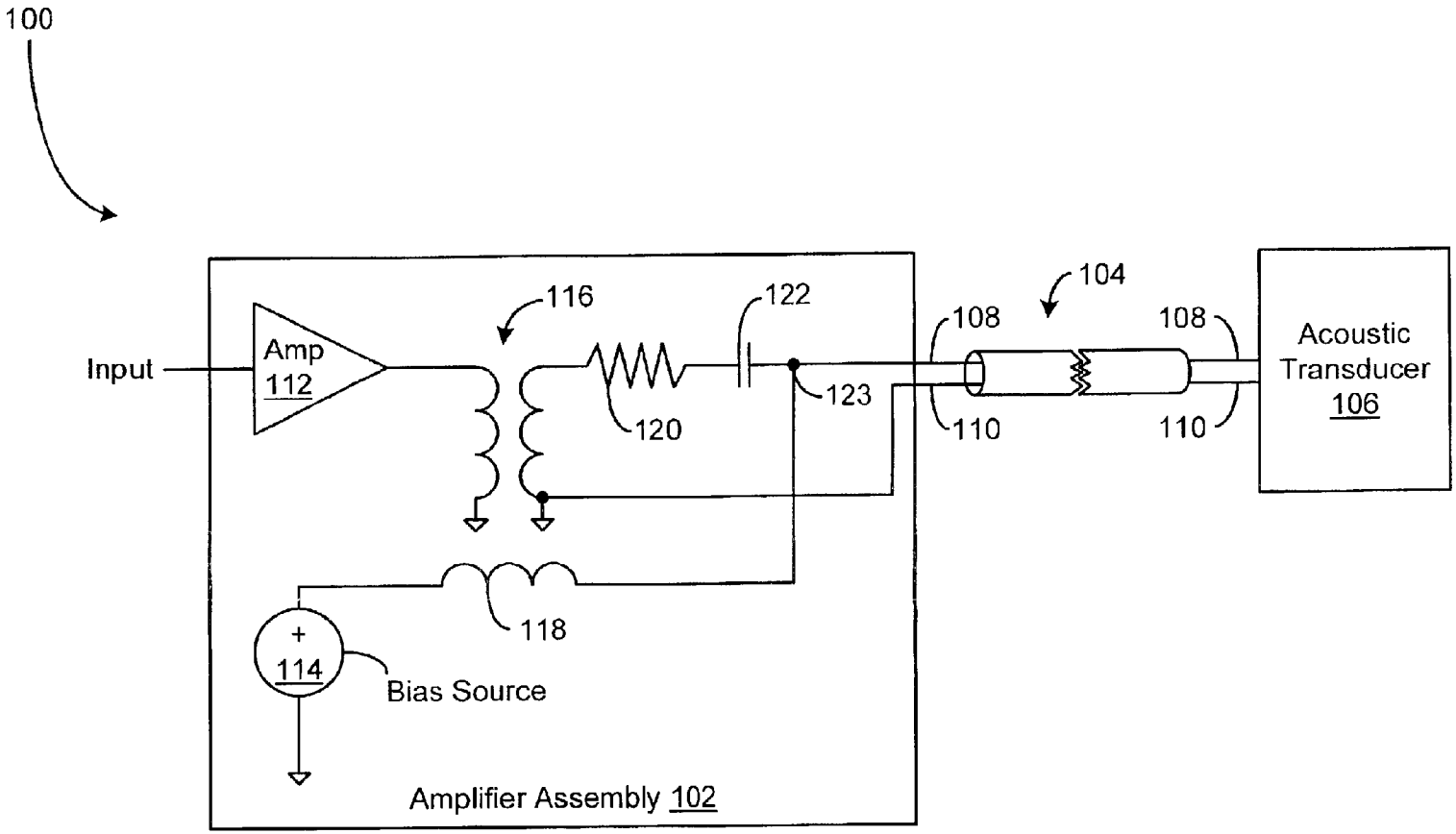
FIG. 1 is a block diagram of a conventional parametric audio amplifier system.

FIG. 1 depicts a block diagram of a conventional parametric audio amplifier system 100, which includes an amplifier assembly 102, an acoustic transducer 106, and a connection cable 104 for interconnecting the amplifier assembly 102 and the acoustic transducer 106. The amplifier assembly 102 is configured to receive an ultrasonic carrier signal modulated with a processed audio signal, and provide an amplified version of the modulated ultrasonic signal to the acoustic transducer 106 by way of the connection cable 104. The amplified version of the modulated ultrasonic signal has voltage characteristics that are suitable for driving the acoustic transducer 106.

Specifically, the amplifier assembly 102 includes a power amplifier 112 that receives the modulated ultrasonic signal as input. The power amplifier 112 amplifies the modulated ultrasonic signal, and provides an amplified ultrasonic signal to a primary winding of a step-up transformer 116. A secondary winding of the step-up transformer 116 provides a stepped-up voltage signal corresponding to the amplified ultrasonic signal to a first conductor 108 of the connection cable 104 by way of a damping resistor 120, which is serially coupled to a DC blocking capacitor 122. Alternatively, a series inductance (not shown) may be employed in place of the step-up transformer 116. It is noted that the stepped-up voltage signal provided by the amplifier assembly 102 to the connection cable 104 has a high voltage level suitable for driving the acoustic transducer 106, e.g., approximately 200–400 $V_{p\text{-}p}$.

Further, the amplifier assembly 102 includes a DC bias voltage source 114 that provides a DC bias voltage level, e.g., approximately 100–400 $V_{DC}$, to the first conductor 108 of the connection cable 104 by way of an AC isolating inductor 118 or a high-valued resistor. For certain acoustic transducer types, a DC bias voltage is often added to the AC signal driving the acoustic transducer. Accordingly, the DC bias voltage level is added to the stepped-up AC voltage signal generated by the step-up transformer 116 at a node 123, and the AC voltage signal offset by the DC bias voltage level is provided to the first conductor 108.

Moreover, the amplifier assembly 102 comprises a ground return path that is coupled to a second conductor 110 of the connection cable 104, which may be the cable shielding.

The acoustic transducer 106 receives the AC voltage signal offset by the DC bias voltage level via the first conductor 108, accesses the ground return path via the second conductor 110, and projects a sonic beam corresponding to the AC signal driving the acoustic transducer 106 through the air for subsequent regeneration of the processed audio signal along a predetermined projection path. It should be noted that the offset AC voltage signal carried by the connection cable 104 is a high voltage signal that can range up to, e.g., approximately 700 volts. Such high voltage signals can adversely impact the size, cost, and complexity of conventional parametric audio amplifier systems.

Figure 2:
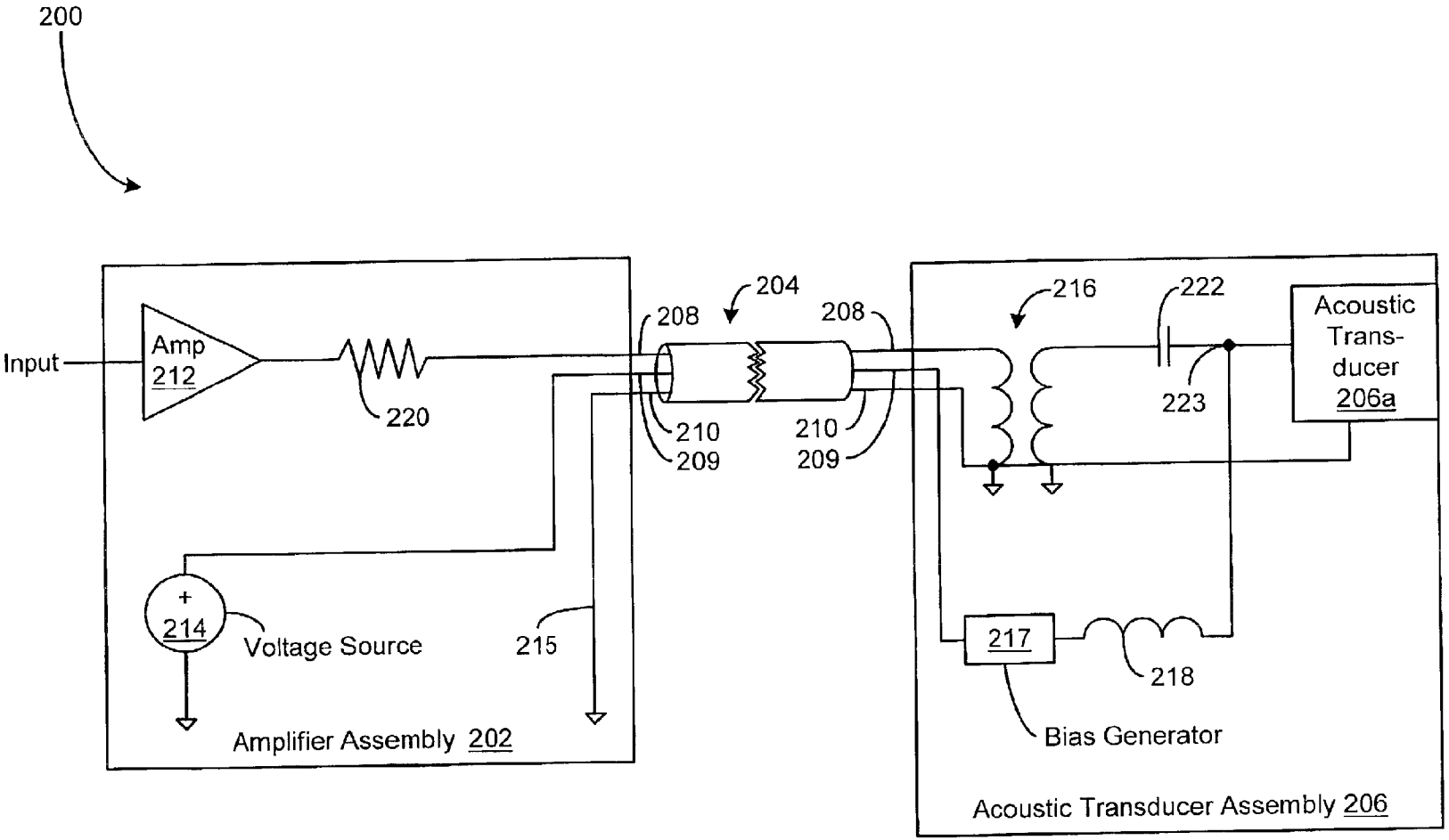
FIG. 2 is a block diagram of a first embodiment of a parametric audio amplifier system in accordance with the present invention.

FIG. 2 depicts a block diagram of a first illustrative embodiment of a parametric audio amplifier system 200 in accordance with the present invention. In the illustrated embodiment, the parametric audio amplifier system 200 is configured so that connections from an amplifier assembly to an acoustic transducer assembly employed therein carry only low voltage signals, and components required for generating high voltage signals suitable for biasing and/or driving an acoustic transducer are disposed in the acoustic transducer assembly.

The parametric audio amplifier system 200 includes an amplifier assembly 202, an acoustic transducer assembly 206, and a connection cable 204 for interconnecting the amplifier assembly 202 and the acoustic transducer assembly 206. For example, the amplifier assembly 202, the connection cable 204, and the acoustic transducer assembly 206 may be employed in a parametric audio system, the structure and operation of which is described in co-pending U.S. patent application Ser. No. 09/758,606 filed Jan. 11, 2001 entitled PARAMETRIC AUDIO SYSTEM, which is incorporated herein by reference.

Specifically, the amplifier assembly 202 includes a power amplifier 212 that receives an ultrasonic carrier signal modulated with a processed audio signal as input. For example, the power amplifier 112 may comprise a class A–D amplifier, a linear amplifier, a switching amplifier, a bridged amplifier, or any other amplifier suitable for amplifying a modulated ultrasonic carrier signal. The power amplifier 212 amplifies the modulated ultrasonic signal, and provides an amplified ultrasonic signal to a first conductor 208 of a connection cable 204 by way of a damping resistor 220. In a preferred embodiment, the damping resistor 220 is employed to broaden the bandwidth of the parametric audio amplifier system 200. It is noted that the amplified ultrasonic signal provided to the connection cable 204 by the amplifier assembly 202 has a relatively low voltage level, e.g., approximately 50 volts.

The parametric audio amplifier system 200 further includes a DC voltage source 214 that provides a DC voltage level, e.g., approximately 12 $V_{DC}$, to a second conductor 209 of the connection cable 204; and, a ground return path that is coupled to a third conductor 210 of the connection cable 204. It should be appreciated that the DC voltage source 214 may be replaced by a low-frequency AC signal for powering circuitry and/or accessories inside the acoustic transducer assembly 206.

The acoustic transducer assembly 206 receives the amplified ultrasonic signal via the first conductor 208, receives the DC voltage level via the second conductor 209, and accesses the ground return path via the third conductor 210 of the connection cable 204. Specifically, the acoustic transducer assembly 206 includes a step-up transformer 216 comprising a primary winding and a secondary winding, a DC bias voltage generator 217, an AC isolating inductor 218, a DC blocking capacitor 222, and at least one acoustic transducer 206*a*.

The primary winding of the step-up transformer 216 receives the amplified ultrasonic signal carried by the first conductor 208, and the secondary winding of the step-up transformer 216 provides a stepped-up voltage signal corresponding to the amplified ultrasonic signal to the acoustic transducer 206*a* by way of the DC blocking capacitor 222. In a preferred embodiment, the inductance of the secondary winding of the step-up transformer 216 is resonant with the capacitance of the acoustic transducer 206*a* at a predetermined ultrasonic frequency, which is preferably within the ultrasonic range reproduced by the acoustic transducer. Such resonance between the inductance of the secondary winding and the capacitance of the acoustic transducer 206*a* causes a high voltage signal, e.g., approximately 200–300 $V_{p-p}$, to be generated, which drives the acoustic transducer 206*a*. For example, the acoustic transducer 206*a* may comprise a membrane-type transducer such as a "Sell-type" electrostatic transducer, a piezoelectric transducer, or any other suitable acoustic transducer.

The DC bias voltage generator 217 receives the DC voltage level via the second conductor 209, and generates a DC bias voltage level suitable for biasing the acoustic transducer 206*a*, e.g., approximately 100–400 $V_{DC}$. It is noted that for certain types of acoustic transducers such as the Sell-type electrostatic transducer, a DC bias voltage is frequently added to the AC signal driving the acoustic transducer to increase the sensitivity of the acoustic transducer and/or reduce ultrasonic distortion in the sonic beam generated by the acoustic transducer.

For example, the DC bias voltage may have a fixed level, or a level that varies according to, e.g., a sensed level of the ultrasonic drive signal. Further, the DC bias voltage generator 217 may include control circuitry configured to modify the DC bias voltage level and/or polarity. Such modifications of the DC bias voltage may be made in response to the sensed level of the ultrasonic drive signal. In an alternative embodiment, the source of energy for the DC bias voltage generator 217 may be the ultrasonic drive signal.

Accordingly, the DC bias voltage level generated by the DC bias voltage generator 217 is provided to a node 223 by way of the AC isolating inductor 218. Further, the DC bias voltage level is added to the stepped-up AC voltage signal generated by the step-up transformer 216 at the node 223, and the AC voltage signal offset by the DC bias voltage level is provided to the acoustic transducer 206*a* as the ultrasonic drive signal.

In a preferred embodiment, the DC blocking capacitor 222 prevents DC current generated by the DC bias voltage generator 217 from flowing through the step-up transformer 216, and the AC isolating inductor 218 blocks the AC driving signal from the DC bias voltage generator 217. It is noted that the AC isolating inductor 218 may be augmented by, or replaced with, a suitable high-value series resistance (not shown). Further, the resonant system formed by the inductance of the secondary winding of the step-up transformer 216 and the capacitance of the acoustic transducer 206*a* is preferably damped by the damping resistor 220 to broaden the frequency response of the system.

In those alternative embodiments in which a DC bias voltage is not added to the AC signal driving the acoustic transducer, the DC blocking capacitor 222 and the AC isolating inductor 218 may be omitted from acoustic transducer assembly. It is also noted that the ground return path employed by the amplifier assembly 202 and received by the acoustic transducer assembly 206 via the third conductor 210 is employed by at least the step-up transformer 216 and the acoustic transducer 206*a*.

The acoustic transducer 206*a* receives the AC driving signal and superimposed bias, and projects a sonic beam corresponding to the AC driving signal through the air to regenerate the processed audio signal along a predetermined projection path. As explained above, the parametric audio amplifier system 200 is configured so that the connection cable 204 interconnecting the amplifier assembly 202 and the acoustic transducer assembly 206 carries only low voltage signal levels, which preferably approximate voltage levels employed by conventional loudspeaker systems. As a result, the size and cost of the parametric audio amplifier system, and the cost and complexity of the installation of the system, can be reduced.

It should be appreciated that the step-up transformer 216 of the acoustic transducer assembly 206 may be replaced by a high-gain amplifier, a resonant inductor, a capacitor, or any other suitable component capable of providing a high voltage signal, either individually or in conjunction with another device and/or the acoustic transducer 206*a*, for driving the acoustic transducer 206*a*.

Figure 3:
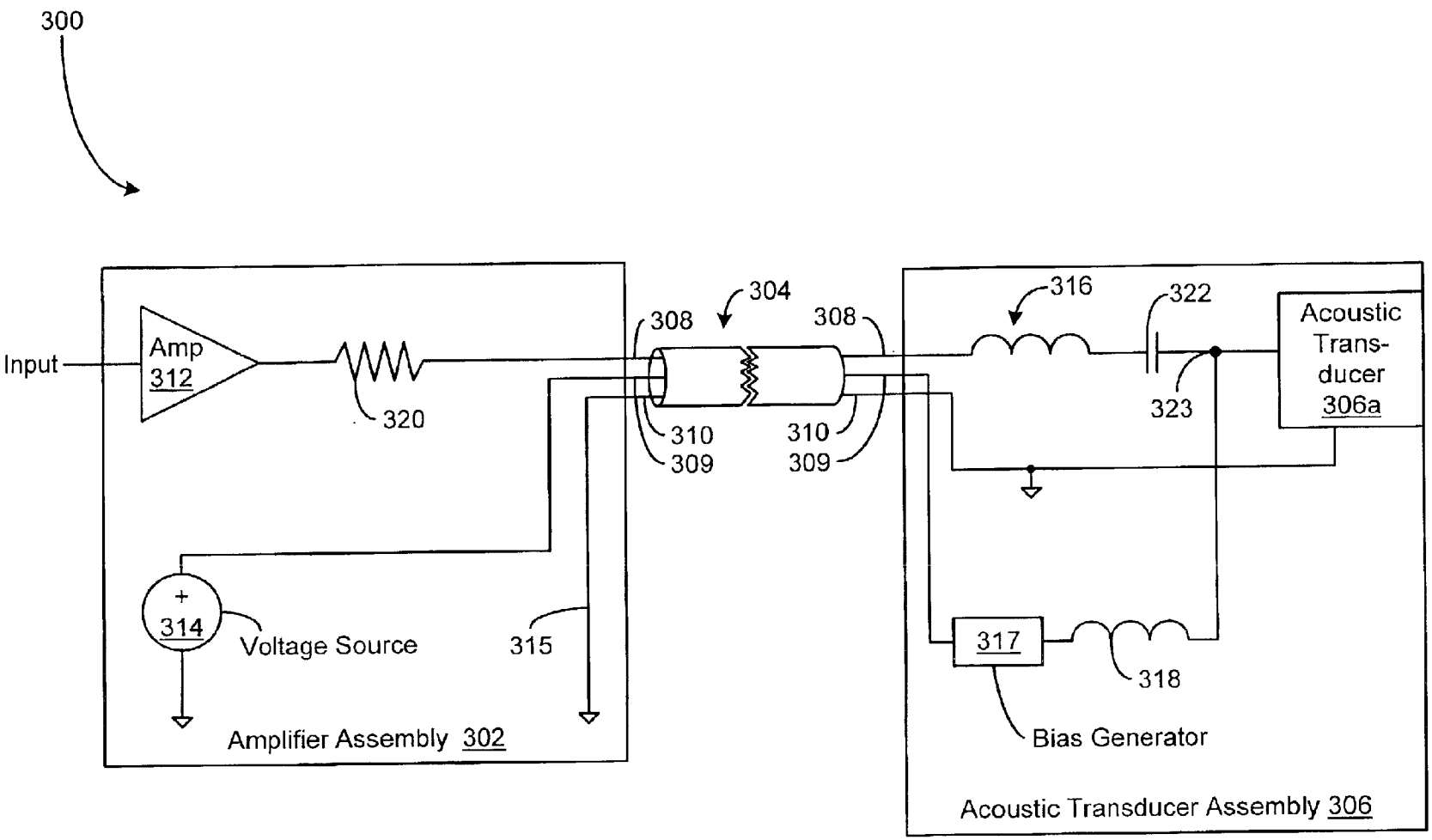
FIG. 3 is a block diagram of a second embodiment of a parametric audio amplifier system in accordance with the present invention.

FIG. 3 depicts a block diagram of a second illustrative embodiment of a parametric audio amplifier system 300 in accordance with the present invention. Like the parametric audio amplifier system 200 (see FIG. 2), the parametric audio amplifier system 300 includes an amplifier assembly 302 comprising a power amplifier 312, a damping resistor 320, and a DC voltage source 314; an acoustic transducer assembly 306 comprising a DC bias voltage generator 317, an AC isolating inductor 318, a DC blocking capacitor 322, and an acoustic transducer 306*a*; and, a connection cable 304 interconnecting the amplifier assembly 302 and the acoustic transducer assembly 306 and configured to carry low voltage signals therebetween.

However, in this second illustrative embodiment, the step-up transformer 216 (see FIG. 2) is replaced by a resonant inductor 316 configured to resonate with the capacitance of the acoustic transducer 306*a* at a predetermined ultrasonic frequency within the ultrasonic range reproduced by the acoustic transducer. In the illustrated embodiment, the resonant inductor 316 may be fixed or variable to allow the inductance to be tuned to resonate with the acoustic transducer capacitance at the predetermined ultrasonic frequency.

It is noted that the above-described first and second illustrative embodiments (see FIGS. 2 and 3) may be configured to drive arrays of acoustic transducers. Further, the first and second embodiments may comprise parallel arrangements of amplifier assemblies, connection cables, and acoustic transducer assemblies to support a number of amplifier channels. Still further, in either the first or second embodiment, a single DC bias voltage generator may be configured to provide suitable biasing for a plurality of acoustic transducers and/or amplifier channels.

It is also noted that the damping resistor 220 (see FIG. 2) and the damping resistor 320 (see FIG. 3) may be disposed in either the amplifier assembly or the acoustic transducer assembly of the respective first and second illustrative embodiments. In a preferred embodiment, the damping resistors 220 and 320 are disposed in the respective amplifier assemblies because these resistors typically dissipate an appreciable amount of heat.

In alternative embodiments, the DC voltage source 214 (see FIG. 2) and the DC voltage source 314 (see FIG. 3) may be implemented as respective AC voltage sources to generate suitable low-frequency AC bias voltages. Further, the levels generated by the voltage sources 214 and 314 may have control information embedded therein, e.g., control information indicative of a desired bias level. Still further, the voltage sources 214 and 314 may be used to power accessories in the respective acoustic transducer assemblies 206 and 306, e.g., an integrated light source such as a laser pointer (not shown).

Figure 4:
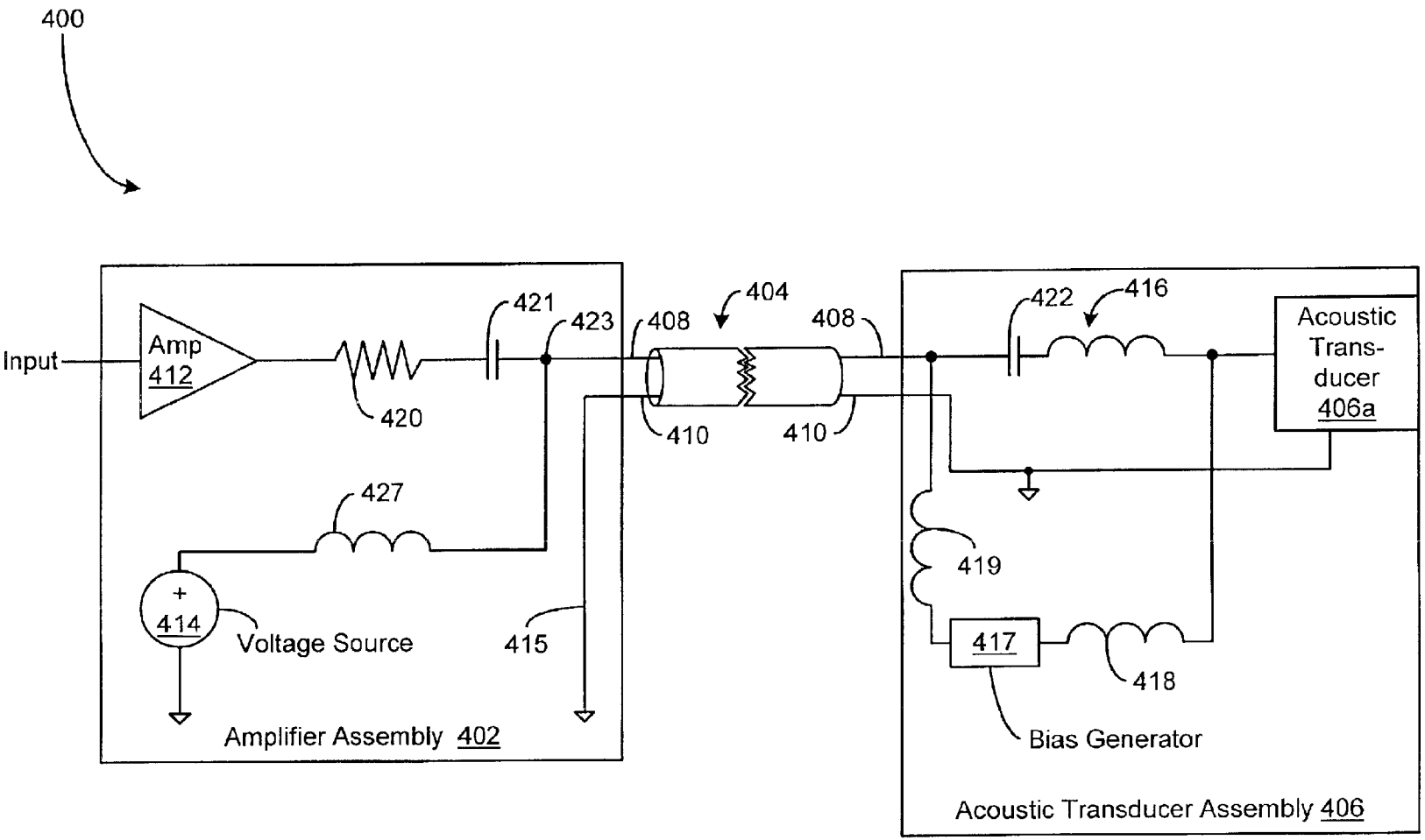
FIG. 4 is a block diagram of a third embodiment of a parametric audio amplifier system in accordance with the present invention.

FIG. 4 depicts a block diagram of a third illustrative embodiment of a parametric audio amplifier system 400 in accordance with the present invention. As in the parametric audio amplifier systems 200 and 300 (see FIGS. 2 and 3), the parametric audio amplifier system 400 includes an amplifier assembly 402, an acoustic transducer assembly 406, and a connection cable 404 for interconnecting the amplifier assembly 402 and the acoustic transducer assembly 406. However, this third embodiment is configured so that fewer conductors are required in the connection cable 404.

Specifically, the amplifier assembly 402 includes a power amplifier 412 that receives a modulated ultrasonic carrier signal as input. The power amplifier 412 amplifies the modulated ultrasonic signal, and provides an amplified ultrasonic signal as an AC drive signal to an acoustic transducer 406*a* included in the acoustic transducer assembly 406 by way of a damping resistor 420, a first DC blocking capacitor 421, the connection cable 404, a second DC blocking capacitor 422, and a resonant inductor 416.

The amplifier assembly 402 also includes a DC voltage source 414 that provides a DC voltage level to a node 423 by way of an AC isolating inductor 427 or a high-valued resistor. The DC voltage level is added to the amplified ultrasonic signal generated by the power amplifier 412 at the node 423, and the amplified ultrasonic signal offset by the DC voltage level is provided to a first conductor 408 of the connection cable 404. In this way, the DC voltage (or a suitable low-frequency AC voltage) can be superimposed onto the amplified ultrasonic signal.

Moreover, the amplifier assembly 402 comprises a ground return path that is coupled to a second conductor 410 of the connection cable 404.

In a preferred embodiment, both the DC blocking capacitor 420 and the DC blocking capacitor 422 have sufficiently large values (e.g., approximately 1$\mu$f) so as to be essentially transparent to the AC drive signal.

When the amplified ultrasonic signal offset by the DC voltage level arrives at the acoustic transducer assembly 406 via the first conductor 408, the AC isolating inductor 419 allows only the DC voltage to reach the DC bias voltage generator 417, and the DC blocking capacitor 422 allows only the AC drive signal to reach the resonant inductor 416 and the acoustic transducer 406*a*.

It should be noted that if the DC bias voltage generator 417 is resilient to incoming AC signals (or uses incoming AC signals directly as an energy source to produce the bias voltage), then the AC isolating inductor 419 may be omitted from the acoustic transducer assembly 406.

Further, if the DC bias voltage generator 417 (and any other devices included in the acoustic transducer assembly 406 that require power) needs a relatively small amount of current, the power amplifier 412 may be configure to supply this current, thereby allowing the DC blocking capacitor 421 and the DC voltage source 414 to be omitted from the amplifier assembly 402. This may be a particularly convenient arrangement for those cases in which the DC voltage is to be precisely controlled by, e.g., a Digital Signal Processor (DSP). For example, the DSP and a Digital-to-Analog Converter (DAC) may generate a suitable offset to be superimposed on the AC drive signal before amplification. Next, the composite signal may be amplified and provided to the acoustic transducer assembly 406 by way of the connection cable 404. The DC bias voltage generator 417 may then generate a DC bias voltage proportional to the incoming level. Other modifications may also be made to accommodate other integrated devices such as a voltage regulator (not shown) for driving a laser pointer. Further, circuitry for detecting whether the acoustic transducer assembly 406 is connected to the amplifier assembly 402 may be provided to allow the DC voltage source 414 to be disabled when not in use.

Although the presently disclosed technique for generating bias and drive signals is well-suited for implementation in parametric audio amplifier systems, it should be appreciated that this technique is also applicable to other audio and communications systems or sonar devices. Further, the connection between the amplifier assembly and the acoustic transducer assembly may be configured to carry control information, e.g., to steer the acoustic transducer and/or control lights or lasers. This control information may be superimposed onto the AC drive signal within an unused frequency range.

It will further be appreciated by those of ordinary skill in the art that modifications to and variations of the above-described parametric audio amplifier system may be made without departing from the inventive concepts disclosed herein. Accordingly, the invention should not be viewed as limited except as by the scope and spirit of the appended claims.

What is claimed is:

1. A parametric audio amplifier system, comprising:

at least one amplifier assembly including at least one amplifier, and a damping resistance having first and second terminals, the amplifier being configured to receive an ultrasonic signal modulated with an audio signal, and to amplify the modulated ultrasonic signal, the damping resistance being configured to receive the amplified ultrasonic signal at its first terminal, and to provide the ultrasonic signal at its second terminal; and at least one acoustic transducer assembly including a bias generator, at least one acoustic transducer, and at least one component interfacing the amplifier assembly and the acoustic transducer, the interface component being configured to receive the ultrasonic signal provided at the second terminal of the damping resistance, and to provide a drive signal corresponding to the ultrasonic signal to the acoustic transducer, the bias generator being configured to generate a bias level, and to provide the bias level to the acoustic transducer, and the acoustic transducer being configured to receive the drive signal and the bias level, to generate a sonic beam corresponding to the drive signal and the bias level, and to project the sonic beam through the air to regenerate the audio signal.

2. The parametric audio amplifier system of claim 1 further including a connection interconnecting the amplifier assembly and the acoustic transducer assembly and configured to carry at least the ultrasonic signal from the amplifier assembly to the acoustic transducer assembly.

3. The parametric audio amplifier system of claim 1 wherein the interface component comprises a step-up transformer including a primary winding configured to receive the ultrasonic signal and a secondary winding configured to provide the drive signal to the acoustic transducer.

4. The parametric audio amplifier system of claim 3 wherein an inductance of the secondary winding is resonant with a capacitance of the acoustic transducer at an ultrasonic frequency.

5. The parametric audio amplifier system of claim 1 wherein the interface component comprises a resonant inductor configured to receive the ultrasonic signal and to provide the drive signal to the acoustic transducer.

6. The parametric audio amplifier system of claim 5 wherein an inductance of the resonant inductor is resonant with a capacitance of the acoustic transducer at an ultrasonic frequency.

7. The parametric audio amplifier system of claim 1 wherein the bias generator is configured to provide a DC bias voltage level to the acoustic transducer.

8. The parametric audio amplifier system of claim 1 wherein the bias generator is configured to provide a low frequency AC bias voltage level to the acoustic transducer.

9. The parametric audio amplifier system of claim 1 wherein the ultrasonic drive signal comprises a source of energy for the bias generator.

10. The parametric audio amplifier system of claim 2 wherein the amplifier assembly further includes at least one voltage source configured to generate a voltage level.

11. The parametric audio amplifier system of claim 10 wherein the voltage source comprises a DC voltage source configured to generate the voltage level having a level no greater than 50 volts.

12. The parametric audio amplifier system of claim 10 wherein the voltage source comprises an AC voltage source configured to generate the voltage level having a level no greater than 50 volts.

13. The parametric audio amplifier system of claim 10 wherein the connection is further configured to carry the voltage level from the amplifier assembly to the acoustic transducer assembly, and the bias generator is further configured to receive the voltage level as input.

14. The parametric audio amplifier system of claim 10 wherein an output of the amplifier and an output of the voltage source are coupled to a node disposed in the amplifier assembly, the node being configured to provide the amplified ultrasonic signal having the voltage level superimposed thereon.

15. The parametric audio amplifier system of claim 14 wherein the connection is further configured to carry the ultrasonic signal having the voltage level superimposed thereon from the amplifier assembly to the acoustic transducer assembly.

16. The parametric audio amplifier system of claim 15 wherein the acoustic transducer assembly further includes a capacitor coupled between the acoustic transducer and the connection to the amplifier assembly, the capacitor being configured to block the voltage level from the acoustic transducer and to provide the ultrasonic signal to the acoustic transducer.

17. The parametric audio amplifier system of claim 15 wherein the acoustic transducer assembly further includes a capacitor coupled between the acoustic transducer and the connection to the amplifier assembly, the capacitor being configured to block the bias level from the connection to the amplifier assembly.

18. The parametric audio amplifier system of claim 15 wherein the acoustic transducer assembly further includes an inductor coupled between the connection to the amplifier assembly and the bias generator, the inductor being configured to block the ultrasonic signal from the bias generator and to provide the voltage level to the bias generator.

19. A method of operating a parametric audio amplifier system, comprising the steps of:

receiving an ultrasonic signal modulated with an audio signal by an amplifier;

amplifying the modulated ultrasonic signal by the amplifier;

receiving the amplified ultrasonic signal at a first terminal of a damping resistance;

providing the ultrasonic signal at a second terminal of the damping resistance; providing the ultrasonic signal to an acoustic transducer assembly by a connection disposed between the second terminal of the damping resistance and the acoustic transducer assembly;

receiving the ultrasonic signal by at least one interface component included in the acoustic transducer assembly;

providing a drive signal corresponding to the ultrasonic signal to at least one acoustic transducer included in the acoustic transducer assembly by the interface component;

providing a bias level to the acoustic transducer by a bias generator included in the acoustic transducer assembly;

receiving the drive signal and the bias level by the acoustic transducer; and generating a sonic beam corresponding to the drive signal and the bias level by the acoustic transducer.

20. The method of claim 19 wherein the amplifier and the damping resistance are disposed in an amplifier assembly, and further including the step of generating a voltage level by a voltage source included in the amplifier assembly.

21. The method of claim 20 wherein the first providing step further includes providing the voltage level to the acoustic transducer assembly by the connection for use by the bias generator included in the acoustic transducer assembly.

* * * * *